US009879923B2

(12) United States Patent
Hambruch et al.

(10) Patent No.: US 9,879,923 B2
(45) Date of Patent: Jan. 30, 2018

(54) FACE PLUMBING ADAPTER FOR A HEAT EXCHANGER ASSEMBLY

(71) Applicant: MAHLE International GmbH, Stuttgart (DE)

(72) Inventors: Joel T. Hambruch, Burt, NY (US); Bruce W. Dittly, North Tonawanda, NY (US); Joseph Coccho, III, Lockport, NY (US); Henry C. Goodman, East Amherst, NY (US)

(73) Assignee: MAHLE International GmbH, Stuttgart (DE)

( * ) Notice: Subject to any disclaimer, the term of this patent is extended or adjusted under 35 U.S.C. 154(b) by 458 days.

(21) Appl. No.: 14/378,408

(22) PCT Filed: Feb. 15, 2013

(86) PCT No.: PCT/US2013/026386
§ 371 (c)(1),
(2) Date: Aug. 13, 2014

(87) PCT Pub. No.: WO2013/123355
PCT Pub. Date: Aug. 22, 2013

(65) Prior Publication Data

US 2015/0034282 A1 Feb. 5, 2015

Related U.S. Application Data

(60) Provisional application No. 61/599,650, filed on Feb. 16, 2012.

(51) Int. Cl.
*F28F 9/04* (2006.01)
*F28F 9/02* (2006.01)
(Continued)

(52) U.S. Cl.
CPC ..... *F28F 9/0246* (2013.01); *F28D 1/05316* (2013.01); *F28D 1/05391* (2013.01);
(Continued)

(58) Field of Classification Search
CPC ..... F28F 9/0246; F28F 9/0248; F28F 9/0256; F28F 9/268
(Continued)

(56) References Cited

U.S. PATENT DOCUMENTS 5,240,068 A * 8/1993 Tokutake ..... B60K 11/04 165/153
5,570,737 A * 11/1996 Tokutake ..... F28D 1/0535 165/67
(Continued)

FOREIGN PATENT DOCUMENTS

CN 202547478 11/2012
GB 315048 A * 7/1929 ..... F16L 3/1215
(Continued)

OTHER PUBLICATIONS

Translation of Korean Patent Document KR 20020087176 A entitled Translation—KR 20020087176 A.*
(Continued)

*Primary Examiner* — Len Tran
*Assistant Examiner* — Paul Alvare
(74) *Attorney, Agent, or Firm* — Brinks Gilson & Lione

(57) ABSTRACT

A face plumbing adapter having a block portion and a camber portion is provided for a manifold of a heat exchanger assembly. The block portion includes an external planar face, a first mating surface opposite that of the planar face, and an aperture having a B-axis extending through the planar face and first mating surface. The camber portion extends integrally from the block portion in a direction away from the planar face and curving inward toward the B-Axis.
(Continued)

The camber portion is biased toward the block portion such that the face plumbing adapter would clinch onto the manifold. The block and camber portions include respective mating surfaces that are complementary to the exterior surface area of the manifold onto which the mating surfaces are affixed.

10 Claims, 4 Drawing Sheets

(51) Int. Cl.

| | |
|---|---|
| ***F28F 9/00*** | (2006.01) |
| ***F16L 41/00*** | (2006.01) |
| ***F28D 1/053*** | (2006.01) |
| *F28F 9/26* | (2006.01) |

(52) U.S. Cl.
CPC ..... *F28F 9/0251* (2013.01); *F28F 9/0256* (2013.01); *F28F 9/0248* (2013.01); *F28F 9/268* (2013.01)

(58) Field of Classification Search
USPC ..... 165/67, 178, 175; 285/197
See application file for complete search history.

(56) References Cited

U.S. PATENT DOCUMENTS

| | | | | |
|---|---|---|---|---|
| 5,685,364 | A * | 11/1997 | Harris | F25B 39/04 165/67 |
| 2008/0135222 | A1 | 6/2008 | Biver et al. | |
| 2011/0073277 | A1 | 3/2011 | Karl et al. | |
| 2011/0140413 | A1 | 6/2011 | Dittly et al. | |
| 2012/0199318 | A1 | 8/2012 | Dittly et al. | |

FOREIGN PATENT DOCUMENTS

| | | | | |
|---|---|---|---|---|
| JP | 06229696 | A * | 8/1994 | |
| KR | 20020087176 | A * | 11/2002 | F28F 9/001 |

OTHER PUBLICATIONS

Translation of Japanese Patent Document JP 06229696 A entitled Translation—JP 06229696 A.*

* cited by examiner

FACE PLUMBING ADAPTER FOR A HEAT EXCHANGER ASSEMBLY

CROSS-REFERENCE TO RELATED APPLICATION

This application claims the benefit of U.S. Provisional Patent Application Ser. No. 61/599,650 for a FACE PLUMBING ADAPTER FOR A HEAT EXCHANGER, filed on Feb. 16, 2012, which is hereby incorporated by reference in its entirety.

TECHNICAL FIELD OF INVENTION

The present invention relates to a heat exchanger assembly; more particularly, to a face plumbing adapter for a heat exchanger assembly.

BACKGROUND OF INVENTION

Air conditioning and heat pump systems for residential and commercial applications are known to employ modified automotive heat exchanger assemblies because of their high heat transfer efficiency, durability, and relative ease of manufacturability. A typical automotive heat exchanger assembly includes an inlet manifold, an outlet manifold, and a plurality of multi-port refrigerant tubes hydraulically connecting the inlet and outlet manifolds. The core of the heat exchanger assembly is defined by the plurality of refrigerant tubes and corrugated fins disposed between adjacent refrigerant tubes for improved heat transfer efficiency and increased structural rigidity.

Certain heat exchanger applications and packaging considerations may require face plumbing of the heat exchanger assembly, in which the inlet and/or outlet connections and associated pipes are within the heat exchanger face dimensions. In other words, at least one of the inlet and/or outlet connections to the manifolds extends substantially perpendicular to the plane on which the core lies. This provides maximum use of the packaging space for heat transfer surface area. A known method to accomplish this to mill an opening equal to the desired diameter of the pipe connection in an area of the manifold that faces the same direction as the core. After the heat exchanger is assembled and brazed, an aluminum pipe is positioned over the opening such that the pipe extends perpendicular to the plane on which the core lies, fixtured, and welded in place. This process is labor intensive resulting in increases in time consumption and cost to manufacture such a heat exchanger assembly.

It is desirable to have a robust face plumbing adapter for a heat exchanger assembly that is simple and cost effective to manufacture, as well as easily attaches onto a manifold of a heat exchanger assembly, in which the face plumbing adapter enables face plumbing of the heat exchanger assembly.

SUMMARY OF THE INVENTION

A face plumbing adapter having a block portion and a camber portion is provided for a manifold of a heat exchanger assembly. The block portion includes an external planar face, a first mating surface opposite that of the planar face, and an aperture having a B-axis extending through the planar face and first mating surface. The camber portion extends integrally from the block portion in a direction away from the planar face and curving inward toward the B-Axis. The camber portion is biased toward the block portion such that the face plumbing adapter would clinch onto the manifold. The block and camber portions include respective mating surfaces that are complementary to the exterior surface area of the manifold onto which the mating surfaces are affixed.

A heat exchanger assembly is also provided having a manifold defining a manifold aperture, a plurality of tubes extending from the manifold in a parallel arrangement perpendicular to the A-axis of the manifold, and a plurality of fins disposed between adjacent tubes, thereby defining a heat exchanger core. A face plumbing adapter is affixed onto the manifold, enabling the manifold to have a plumbing connection perpendicular to the heat exchanger core. The face plumbing adapter includes a first portion having a face defining a first portion aperture and a second portion extending integrally from the first portion in a direction away from the face. The second portion is biased toward the first portion such that the face plumbing adapter is clinched onto the manifold, in which the first portion aperture lies in a plane parallel to the core heat exchanger assembly and is in hydraulic communication with the manifold aperture.

The embodiment of the face plumbing adapter allows the use of known standard plumbing methods to provide for a plumbing connection to a manifold to extend in a direction that is substantially perpendicular to the core. The face plumbing adapter replaces the more costly process of milling a hole onto the manifold and welding a connection to the manifold. Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
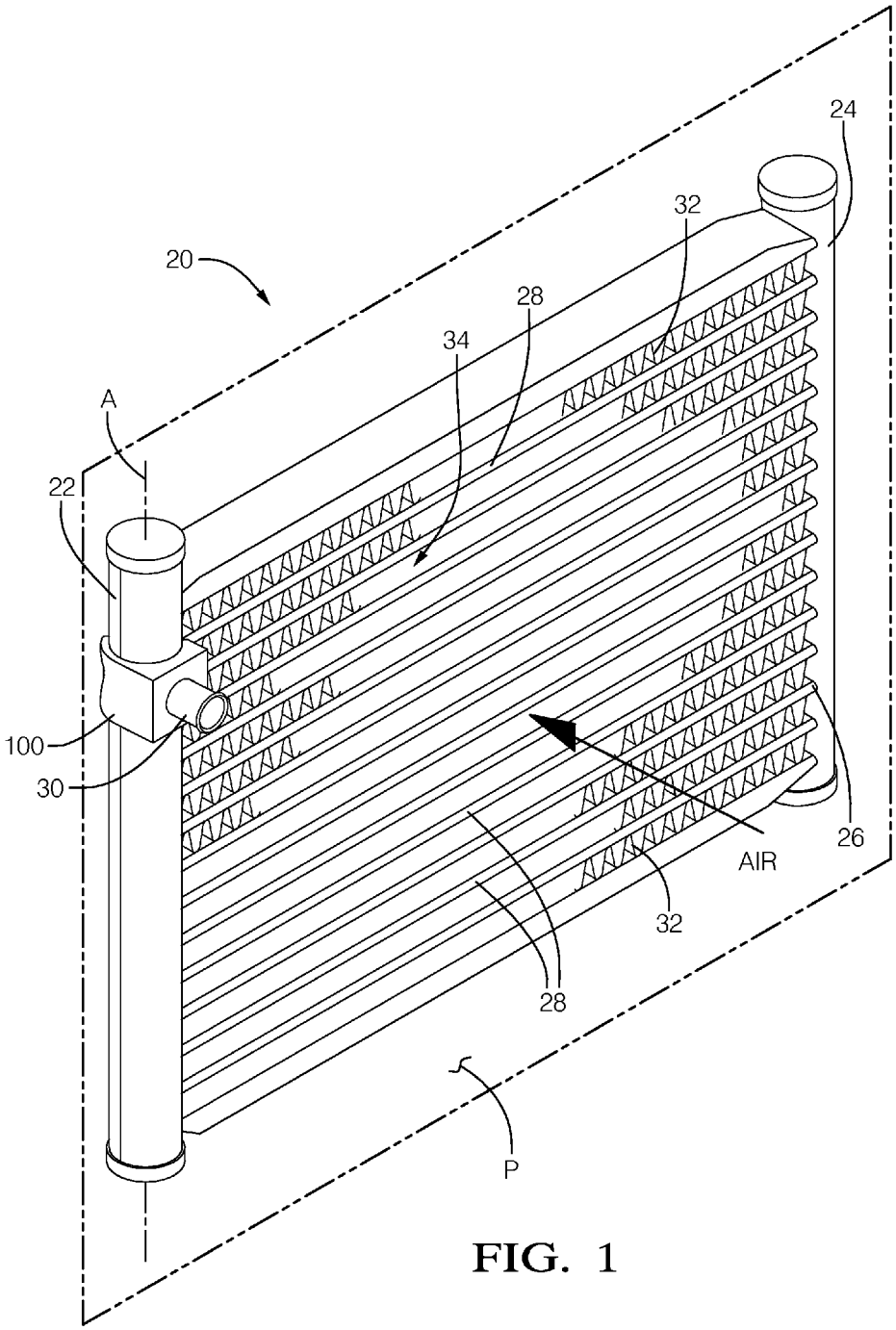
FIG. 1 shows a perspective front view of an exemplary embodiment of a face plumbing adapter engaged to a manifold of a heat exchanger assembly.

Referring to FIGS. 1 through 6, wherein like numerals indicate corresponding parts throughout the several views, is an exemplary embodiment of a heat exchanger assembly 20 having a face plumbing adapter 100. The face plumbing adapter 100 enables an inlet and/or outlet plumbing connection 30 to a manifold 22, 24 to extend in a direction substantially perpendicular to the core 34 of the exchanger assembly 20. The face plumbing adapter 100 may be snapped or clinched onto the exterior surface of the manifold 22, 24 and affixed in place by brazing.

Shown in FIG. 1 is a perspective front view of an exemplary embodiment of the face plumbing adapter 100 engaged to a manifold 22 of the heat exchanger assembly 20. The heat exchanger assembly 20 includes a first manifold 22 extending along a manifold A-axis and a second manifold 24 extending in a spaced and substantially parallel relationship with the first manifold 22. The first and second manifolds 22, 24 present a plurality of corresponding tube slots 26 spaced along the respective manifolds 22, 24. A plurality of fluid tubes 28 is inserted into the corresponding tube slots 26 of the manifolds 22 in a parallel arrangement for hydraulic fluid communication between the manifolds 22, 24. A plurality of corrugated fins 32 is inserted between adjacent fluid tubes 28 for increased heat transfer efficiency between the fluid in the tubes 28 and a stream of ambient air. The plurality of tubes 28 and corrugated fins 32 between adjacent tubes 28 define the heat exchanger core 34, which lies on a plane P.

Affixed to the first manifold 22 is the face plumbing adapter 100, which enables the plumbing connection 30 to the first manifold 22 to extend substantially perpendicular to the core 34. Substantially perpendicular to the core 34 means that the plumbing connection 30 extends in a direction about 80 to 100 degrees, preferably 90 degrees, relative to the plane P in order to meet the packaging requirements of certain applications.

Figure 2:
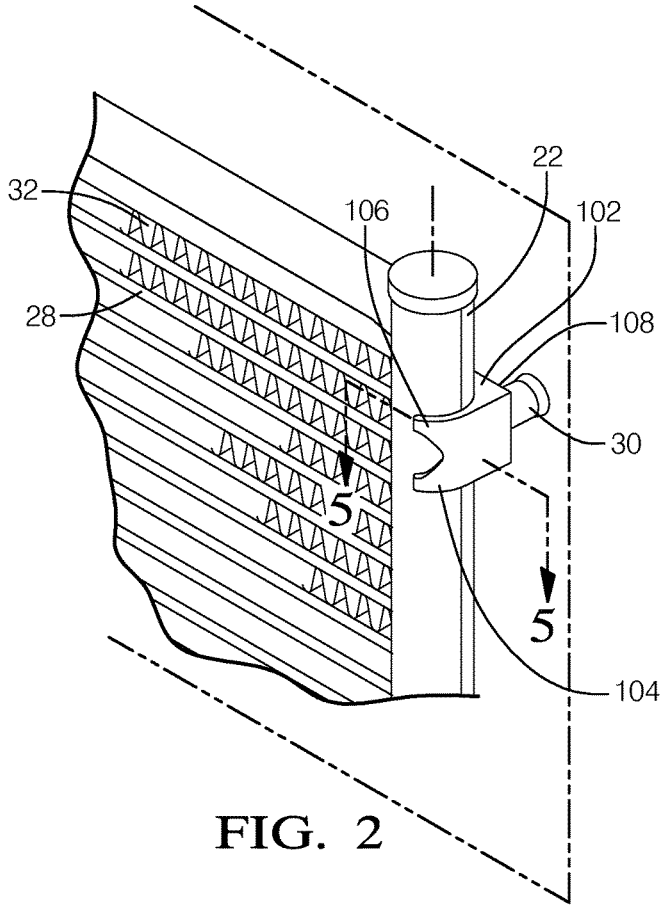
FIG. 2 shows a partial perspective rear view of the face plumbing adapter engaged to the manifold of the heat exchanger assembly of FIG. 1.
Figure 5:
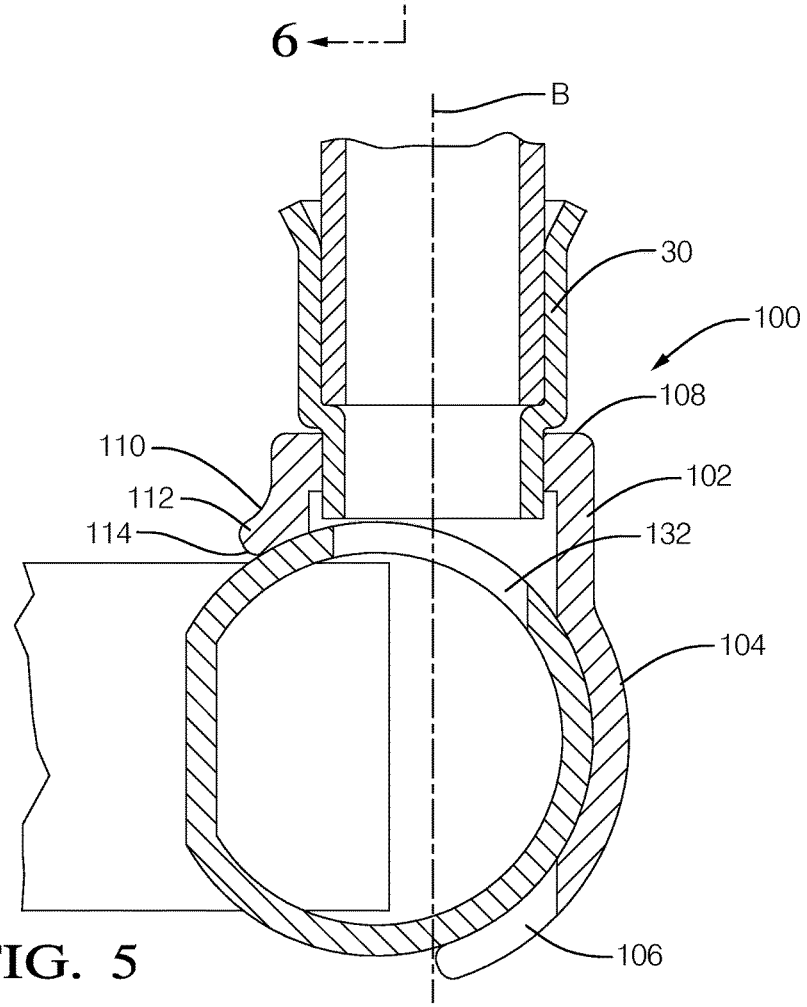
FIG. 5 is a partial cross sectional view of the manifold of the heat exchanger assembly of FIG. 2 taken along line 5-5.

Referring to FIGS. 2 and 5, in which FIG. 2 shows a partial perspective rear view of the face plumbing adapter 100 engaged to the manifold 22 and FIG. 5 shows a partial cross sectional view of the face plumbing adapter 100 of FIG. 2. The face plumbing adapter 100 includes a first portion 102 and a second portion 104 biased toward the first portion 102 such that the face plumbing adapter 100 snaps and clinches onto the exterior surface of the manifold 22. The first portion 102 may block shape, block portion 102, and the second portion 104 may have a camber shape, camber portion 104. The block portion 102 includes an external planar face 108 and defines a block aperture 128 having a central B-Axis. The camber portion 104 extends integrally from the block portion 102 in a direction away from the planar face 108 and curves inward toward the central B-axis. The block portion 102 also includes an edge 110 opposite from the camber portion 104, in which the edge 110 defines a nose 112 having an undercut 114.

Figure 4:
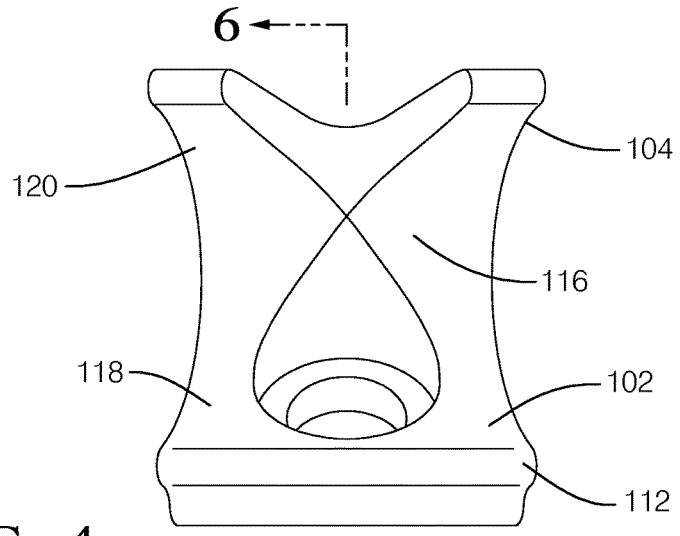
FIG. 4 is a side view of the face pluming adapter of FIG. 1 showing the interior mating surfaces of the face plumbing adapter.

Best shown in FIG. 4, is a side view of the face plumbing adapter 100 of FIG. 1 showing the interior surfaces 116 of the face plumbing adapter 100. The block portion 102 includes a first mating surface 118 and the camber portion 104 includes a second mating surface 120. The first and second mating surfaces 118, 120 are complementary to exterior surface area of the manifold 22 onto which the first and second mating surfaces 118, 120 are affixed. Once the face plumbing adapter 100 is assembled onto the manifold 22, the nose 112 section of the block portion 102 cooperates with the biased camber portion 104 to clinch the face plumbing adapter 100 onto the exterior mating surface area of the manifold 22 as shown in FIGS. 1 and 2.

Figure 3:
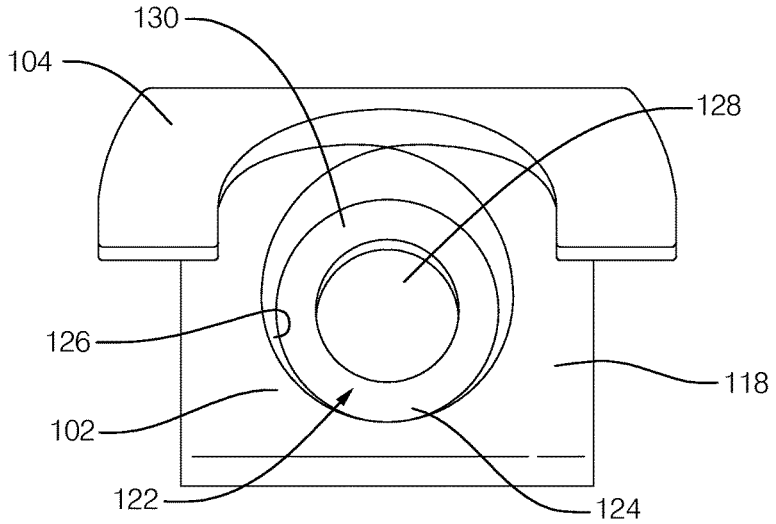
FIG. 3 is an end view of the face pluming adapter of FIG. 1 showing an interior surface having a bore with an end wall defining an aperture.

Best shown in FIG. 3, the block portion 102 defines a bore 122 having a bore end 124 surrounded by a bore side wall 126, in which the bore 122 is in hydraulic communication with the block aperture 128. The bore 122 extends in a direction parallel to the B-axis and may be concentrically located with the block aperture 128. The bore 122 may have a diameter larger than the diameter of the block aperture 128 such that a ledge 130 is defined between the block aperture 128 and the bore side wall 126. A portion of the manifold 22 onto which the face plumbing adapter 100 is affixed defines a manifold aperture 132 that is smaller than the bore 122 diameter. The larger bore diameter allows multiple sizes of block aperture 128 to be milled through the planar face 108 to accommodate various size piping connections. The bore 122 provides hydraulic communication between the block aperture 128 and manifold aperture 132.

Figure 6:
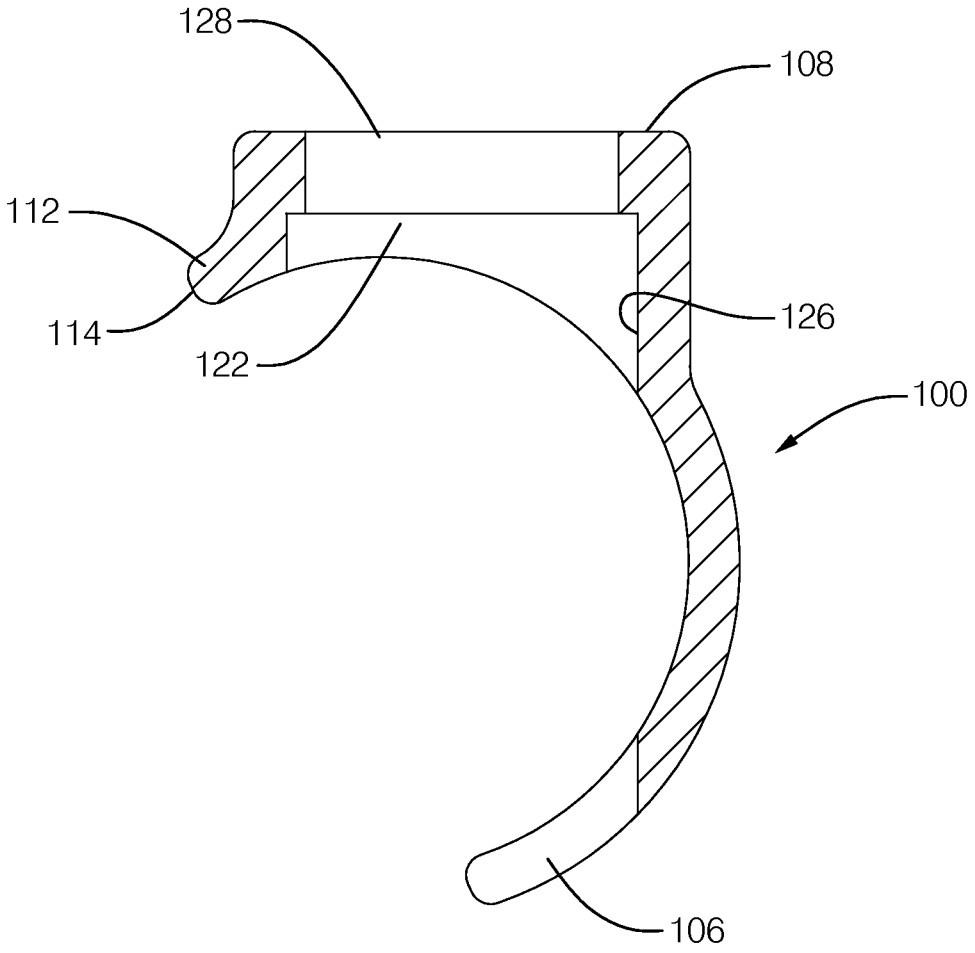
FIG. 6 is a cross sectional view of the face plumbing adapter of FIG. 4 taken along line 6-6.

Referring to FIG. 6, in the manufacturing of the face plumbing adapter 100, the drilling of the bore 122 from the back side of the face plumbing adapter 100 defines the two prongs 106 having a V type configuration on a distal end of the camber portion 104. This V type configuration together with the undercut 114 defined by the nose 112 reduces the total surface mating area between the face plumbing adapter 100 and manifold 22, and increases the linear distance available for a braze fillet to form. The increase length of the braze fillet provides a more robust braze joint as opposed to a greater surface mating area.

The face plumbing adapter 100 may be continuously extruded from aluminum and then cut into multiple units, each having a desired dimension to accommodate different size clinching of production couplers. A common manifold aperture 132 size can be milled into the manifold 22 for most applications while only milling the block aperture 128 to the desired design criteria, thereby reducing set up time and manufacturing cost.

The embodiment of face plumbing adapter 100 of the invention allows the use of known standard plumbing methods to provide for a plumbing connection 30 to a manifold 22 of the heat exchanger assembly 20, in which the plumbing connection 30 extends in a direction that is substantially perpendicular to the plane P on which the core 34 lies. The interface of the bore 122 between the block aperture 128 and manifold aperture 132 allows a wider tolerance between the size the manifold 22 aperture and block aperture 128. This is advantageous, since the manifold aperture 132 may be standardized and the block aperture 128 can be milled to provide the desired flow rate for different applications, or vice versa. Another advantage is that the face plumbing adapter 100 replaces the more costly process of milling a hole onto the manifold 22 and welding a connection to the manifold 22.

While this invention has been described in terms of the preferred embodiments thereof, it is not intended to be so limited, but rather only to the extent set forth in the claims that follow.

Having described the invention, it is claimed:

1. A face plumbing adapter for a manifold of a heat exchanger assembly, wherein the manifold extends along a manifold axis, the face plumbing adapter comprising:

a block portion having an external planar face and an opposite first mating surface portion, wherein the block portion defines a block aperture extending along a center axis through the external planar face and the first mating surface portion;

a camber portion extending integrally from the block portion in a direction away from the external planar face and curving inward toward the center axis, wherein the camber portion includes a second mating surface portion extending from the first mating surface portion, wherein the first mating surface portion and the second mating surface portion together form a mating surface complementary to an exterior surface area of the manifold onto which the mating surface is affixed, and wherein the camber portion includes a distal end opposite the aperture with respect to the manifold axis, the distal end defining two prongs forming part of the second mating surface portion and curving inward toward the center axis, the two prongs being spaced apart along the manifold axis, wherein a bore coaxial with the block aperture extends into the block portion from the first mating surface portion and has a larger diameter than the diameter of the block aperture, the bore including an end wall circumscribing the block aperture, thereby defining a ledge, wherein the two prongs are arranged on opposite sides of and outside of the diameter of the bore projected along the center axis.

2. The face plumbing adapter for a manifold of a heat exchanger assembly of claim 1, wherein the block portion includes an edge defining a nose opposite with respect to the manifold axis from the two prongs of the camber portion.

3. The face plumbing adapter for a manifold of a heat exchanger assembly of claim 2, wherein the nose and the two prongs are configured to cooperate in engaging the manifold such that the face plumbing adapter is clinched onto the manifold.

4. The face plumbing adapter for a manifold of a heat exchanger assembly of claim 3, wherein the nose defines an undercut and the two prongs defines a V-shape, thereby increasing a linear distance available for forming a braze fillet.

5. The face plumbing adapter for a manifold of a heat exchanger assembly of claim 1, wherein:

the block aperture extending along the center axis is 80 to 100 degrees relative to the external planar face; and the distal end is immediately adjacent to the center axis of the block bore.

6. The face plumbing adapter for a manifold of a heat exchanger assembly of claim 5, wherein the camber portion is biased toward the block portion such that the face plumbing adapter clinches onto the manifold.

7. The face plumbing adapter for a manifold of a heat exchanger assembly of claim 6, wherein the block aperture extending along the center axis is perpendicular to the external planar face.

8. A heat exchanger assembly comprising:

a manifold extending along an A-axis, the manifold includes a side defining a manifold aperture;

a plurality of tubes extending from the manifold in a parallel arrangement perpendicular to the A-axis;

a plurality of fins disposed between adjacent tubes, thereby defining a heat exchanger core lying on a plane P; and a face plumbing adapter including a first portion having a face, the first portion being a block portion, a first portion aperture extending through the face about a center axis intersecting the manifold aperture, and a second portion being a camber portion and extending integrally from one side of the first portion in a direction away from the face and having a distal end opposite the first portion aperture, the distal end defining two prongs forming part of a second mating surface portion and curving inward toward the center axis, the two prongs being spaced apart along the manifold axis wherein the second portion is biased toward the center axis such that the face plumbing adapter is clinched onto the manifold, wherein the face lies in a plane parallel to the plane P and the first portion aperture is in hydraulic communication with the manifold aperture, wherein the first portion includes a first mating surface portion opposite from the face and a bore, coaxial with the center axis extending through the first mating surface portion into the first portion, the bore having a diameter larger than the diameter of the first portion aperture, wherein the bore is in hydraulic communication with the manifold aperture and with the first portion aperture, wherein the two prongs are arranged on opposite sides of and outside of the diameter of the bore projected along the center axis.

9. The heat exchanger assembly of claim 8, wherein the two prongs define a V-shape.

10. The heat exchanger assembly of claim 8, wherein the block portion includes an edge defining a nose opposite from the camber portion.

* * * * *